US011688371B2

(12) United States Patent
Lansakara

(10) Patent No.: US 11,688,371 B2
(45) Date of Patent: Jun. 27, 2023

(54) ZIPPER GUITAR STRAP

(71) Applicant: Crishan Kenneth Lansakara, Singapore (SG)

(72) Inventor: Crishan Kenneth Lansakara, Singapore (SG)

( * ) Notice: Subject to any disclaimer, the term of this patent is extended or adjusted under 35 U.S.C. 154(b) by 0 days.

(21) Appl. No.: 17/577,354

(22) Filed: Jan. 17, 2022

(65) Prior Publication Data

US 2023/0052853 A1 Feb. 16, 2023

(30) Foreign Application Priority Data

Aug. 12, 2021 (SG) ..... 10202108782Q

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00
See application file for complete search history.

(56) References Cited

FOREIGN PATENT DOCUMENTS

CN 206058889 U * 3/2017 ..... G10D 3/00

* cited by examiner

*Primary Examiner* — Kimberly R Lockett
(74) *Attorney, Agent, or Firm* — JCIP; Joseph G. Chu; Jeremy I. Maynard

(57) ABSTRACT

An adjustable length strap assembly, including a length of a strapping material having a terminal end secured to an anchoring point located on a rear portion of a body of a stringed instrument, said length threaded through a first leveraging portion of a leveraging member and folded, such that a section of the length of the strapping material is folded over to form a two ply configuration of strapping material consisting of a top ply and a bottom ply, with slid-able longitudinal movement of each ply leveraged by said first leveraging portion of the leveraging member; and a second portion defined by a tongue capable of swivelling about a second leveraging portion of the leveraging member; wherein the slid-able longitudinal movement of the bottom ply relative to the top ply is regulated by movement of a slider of a longitudinally oriented slide-fastening mechanism formed integrally to the top ply.

11 Claims, 5 Drawing Sheets

ZIPPER GUITAR STRAP

RELATED APPLICATIONS

This application claims priority to, and the benefits of, the Singapore Patent 5 Application No. 10202108782Q filed on Aug. 12, 2021, the content of which is incorporated in its entirety herein.

FIELD OF THE INVENTION

The present invention relates to the field of stringed musical instruments. More particularly, present invention relates to a stringed instrument of the type held in front of the performer or user while it is being played, while the strings are plucked. Most particularly, the present invention relates to an adjustable length strap assembly for use with a stringed musical instrument, particularly the guitar.

BACKGROUND OF THE INVENTION

Modern music is made with a plethora of stringed instruments in a variety of performance genres, from orchestras to rock bands to folk music. These instruments vary in size, shape, sound, string configuration, etc. The present invention is designed to be used with those stringed instruments which the player holds in a generally horizontally position and plays by plucking the strings. Chief among such instruments is the guitar. Although its history and development is somewhat uncertain, it is believed that the guitar first appeared in the 12th century. Modern variations include the classical, archtop, steel string, and electric guitars. Other similar instruments include the banjo, ukulele, and the like.

When performing, many guitarists prefer to stand and hold their musical instruments, a procedure that appears to be preferable among rock, country and folk musicians. Since it is difficult to both hold a guitar and simultaneously play the instrument, many musicians use a strap or harness to support the instrument in a comfortable playing position in order to free their hands to play the instrument. Most conventional straps for guitars attach to the musical instrument at two anchor points on the body. These anchor points are characterized by a pin or stud that has been inserted into the body of the guitar or adhered to the outer surface of its body. One anchor point is typically located on a side of the instrument adjacent to the neck, while the other is on an opposite side of the instrument's body opposite the neck. When attached to the anchor points, such a strap can be placed around the person's neck and supported on their shoulder to hold the guitar in a convenient manner for playing the instrument. Accordingly, conventional guitar straps are merely directed at allowing a guitar to be secured to the musician's body while allowing the musician to fully utilize his/her hands to strum the guitar chords. Most conventional strap assemblies for guitars and other similarly stringed musical instruments, do not readily appear to provision for an adjustable length of strap that allows for optimized positioning of a given stringed musical instrument in question to allow the musician comfort when playing the instrument, depending on the anthropometrics of the musician.

Moreover, another drawback of fixed length strap assemblies is that in view of the fact that usually a short length of strap is hung over the shoulder, diagonally wrapping over the back of the musician, in order for the musician to remove the stringed instrument, presumably a guitar, the strap ends secured to the anchor points of the musical instrument, have to be removed. This is a laborious, cumbersome and inconvenient process which the musician can do without, to say the least. Moreover, in order to circumvent removal of the strap ends secured to the anchor points, an alternative (in regard to a fixed length strap assembly) is for the musician to simply slide the stringed musical instrument over the head and neck. This however, requires the musician to perform a series of contortions and may result in injury.

While there are strap assemblies for stringed musical instruments made available in the market which do provision for length adjustment, particularly strap assemblies for guitars, these strap assemblies require that length adjustment of the strap be executed by the musician prior to donning of the musical instrument. Conventional straps do not allow the player to adjust the length of the strap belt with the guitar hung down from the shoulders of the player. As a result, each time the length of the strap belt is to be adjusted, the player must put down the guitar repeatedly and then put it back around the shoulders to see whether the adjustment is appropriate. Such continuous adjustment is extremely inefficient and troublesome for the user or player, especially during events such as live concerts. Additionally, since the user isn't wearing the strap during adjustment, it is difficult to tell how much adjustment is needed and multiple adjustments are often required to get the desired length.

It is thus needless to point out that conventional strap assemblies, even ones that are adjustable, do not allow for rapid length adjustment of a length of strap hung over the shoulder of the musician, which is often required, particularly in the case of a guitar in which the musician has to often times effect a subtle change in the position of the instrument in order to effect a corresponding change to the beat of a tune being played. Specifically, when playing a guitar, the guitar is normally located on the player about midway across the chest of the player. This is a comfortable position for the player when playing a melody or accompanying a singer by providing the background cords of the tune. However, when the beat of a tune changes dramatically, the player must produce a heavy beat which is best being produced when the guitar is at a much lower position so that the strumming hand is at about the length of an arm of a player. Therefore, it is desirable, that the length of the strap supporting the guitar around the back of the player, be changed rapidly as the tune of the music changes its beat dramatically.

Accordingly, it would thus be desirable to conceive an adjustable length strap assembly for stringed musical instruments, particularly the guitar, which mitigates if not overcome the disadvantages and problems of prior art strap assemblies elucidated above.

SUMMARY OF THE INVENTION

The following presents a simplified summary of the invention in order to provide a basic understanding of some aspects of the invention. This summary is not an extensive overview of the invention. It is not intended to identify key/critical elements of the invention. Its sole purpose is to present some concepts of the invention in a simplified form as a prelude to the more detailed description that is presented later.

The present invention provides an adjustable length strap assembly adapted for use with a stringed musical instrument of the type held in front of the user of the instrument or performer, while it is being played by strumming of its strings by the user or performer, particularly a guitar, the adjustable length strap assembly comprises:

a first portion defined in part by a length of a strapping material having a terminal end configured to be secured to an anchoring point located on a rear portion of a body of the stringed musical instrument, said length of strapping material threaded through a substantially ring-shaped leveraging member via a first leveraging portion and folded, such that a section of the length of the strapping material is folded over itself, to form a section having a two ply configuration of strapping material consisting of a first top ply and a second bottom ply, with slid-able longitudinal movement of each ply relative to the other leveraged by said first leveraging portion of the substantially ring-shaped leveraging member; and a second portion defined by a tongue capable of swivelling about a second leveraging portion of the substantially ring shaped leveraging member, the tongue configured to attach to an anchoring point located on a head portion of the body of the stringed musical instrument;

characterized in that;

the slid-able longitudinal movement of the second bottom ply of strapping material of the first portion of the strap assembly relative to the first top ply of strapping material of the first portion of the strap assembly is regulated by movement of a slider of a longitudinally oriented slide-fastening mechanism formed integrally to the first top ply; and wherein the slider is mechanically linked to a terminal portion of the second bottom ply by way of a flexible mechanical interlink such that longitudinal slid-able motion of the slider of the slide-fastening mechanism formed integrally to the first top ply allows a corresponding slid-able longitudinal movement of the second bottom ply and thereby provides for an adjustable length of strapping material of the strap assembly to be worn over the shoulder and around the neck and back of the user or performer.

In accordance to one embodiment of the adjustable length strap assembly of the present invention, the longitudinally oriented slide-fastening mechanism formed integral to the first top ply of strapping material of the first portion of the adjustable length strap assembly is selected from a list comprising a zip-lock mechanism and a zipper mechanism.

In accordance to another embodiment of the adjustable length strap assembly of the present invention, the longitudinally oriented slide-fastening mechanism formed integral to the first top ply of strapping material of the first portion of the strap assembly is a zipper mechanism having a slider incorporating a locking mechanism which prevents motion of the slider along the track of the zipper mechanism when the locking mechanism is engaged. More particularly, in accordance to a preferable embodiment of the present invention, the longitudinally oriented slide-fastening mechanism is a zipper mechanism incorporating a slider selected from a list including a pin lock slider and a key-lock slider.

In accordance to also another embodiment of the adjustable length strap assembly of the present invention, the longitudinally oriented slide-fastening mechanism formed integral to the first top ply of strapping material of the first portion of the strap assembly is a closed bottom zipper mechanism.

In accordance to yet another embodiment of the adjustable length strap assembly of the present invention, the flexible mechanical interlink, mechanically interlinking the slider of the slide-fastening mechanism to the terminal portion of the second bottom ply of strapping material, is a chain-link flexible mechanical interlink.

In accordance to a further embodiment of the adjustable length strap assembly of the present invention, the slider of the slide-fastening mechanism is further adapted to receive and house a latching member. In accordance to said embodiment of the present invention, the first top ply of strapping material of the first portion of the strap assembly is further disposed with a plurality of spaced apart positional locking tab members distributed alongside the entire length of the longitudinally oriented slide-fastening mechanism. It is preferred that the plurality of spaced apart position locking tab members is a plurality of equidistantly spaced apart positional locking tab members distributed alongside the entire length of the longitudinally oriented slide-fastening mechanism. Each positional locking tab member is configured to act in cooperation with the slider of the longitudinally oriented slide-fastening mechanism to limit the longitudinal mobility of the slider over a predefined interval of length by way of a latching member adaptably received and housed by the slider and serving to mechanically latch and interlock the slider to a given positional locking tab member. Preferably, the latching member is selected from a list including a carabiner and any hook-like latch implement.

In accordance to an embodiment of the adjustable length strap assembly of the present invention, the terminal end of the length of strapping material of the first portion of the strap assembly is adaptably configured to attach to an anchoring point located on a head portion of a body of the stringed musical instrument by way of being disposed with a slit aperture adapted to snugly fit over an anchoring point taking the form of a strap attachment stud or strap attachment button.

In accordance to another embodiment of the adjustable length strap assembly of the present invention, the tongue of the second portion of the strap assembly is disposed on its substantially planar surface with a slit aperture adapted to snugly fit over an anchoring point located at a back portion of the body of the stringed musical instrument and taking the form of a strap attachment stud or strap attachment button.

In a preferred embodiment, the substantially ring shaped leveraging member is fabricated from a material, which can be selected from the list that includes metal, nylon coated metal, electro-plated metal, plastic and resin.

In another preferred embodiment, the strapping material of the first portion of the strap assembly is manufactured from a material, which can be selected from the list that includes webbing made of nylon, cotton fibre, polypropylene and neoprene.

In also another preferred embodiment, the strapping material of the first portion of the strap assembly is manufactured from a material, which can be selected from the list that includes leather and faux leather.

In yet another preferred embodiment, the tongue of the second portion of the strap assembly is manufactured from a material, which can be selected from the list that includes webbing made of nylon, cotton fibres, polypropylene and neoprene.

In another preferred embodiment, the tongue of the second portion of the strap assembly is manufactured from a material, which can be selected from the list that includes leather and faux leather.

It is an advantage of the present invention to provide a strap assembly for use with a stringed musical instrument that mitigates the incidence of neck and/or back, and other related injuries to a musician or user of the instrument.

It is another advantage of the present invention to provide a strap assembly adapted for use with a stringed musical instrument, which allows for adjustment of a length of a strap secured to said stringed musical instrument at an anchoring point and worn over the shoulder and around the neck and back of a musician or user of the instrument.

It is also another advantage of the present invention to provide a strap assembly adapted for use with a stringed musical instrument, which allows for rapid and subtle adjustment of a length of strap secured to said stringed musical instrument at an anchoring point and worn over the shoulder and around the neck and back of a performer or musician or user of the instrument.

BRIEF DESCRIPTION OF THE DRAWINGS

The above and other objects, features and other advantages of the present invention will be more clearly understood from the detailed description taken in conjunction with the accompanying drawings, in which.

DETAILED DESCRIPTION OF THE INVENTION

The detailed description set forth below in connection with the appended drawings is intended as a description of an exemplary embodiment and is not intended to represent the only form in which the embodiment may be constructed and/or utilized. The description sets forth the functions and the sequence for constructing the exemplary embodiment. However, it is to be understood that the same or equivalent functions and sequences may be accomplished by different embodiments that are also intended to be encompassed within the scope of this disclosure.

Figure 1:
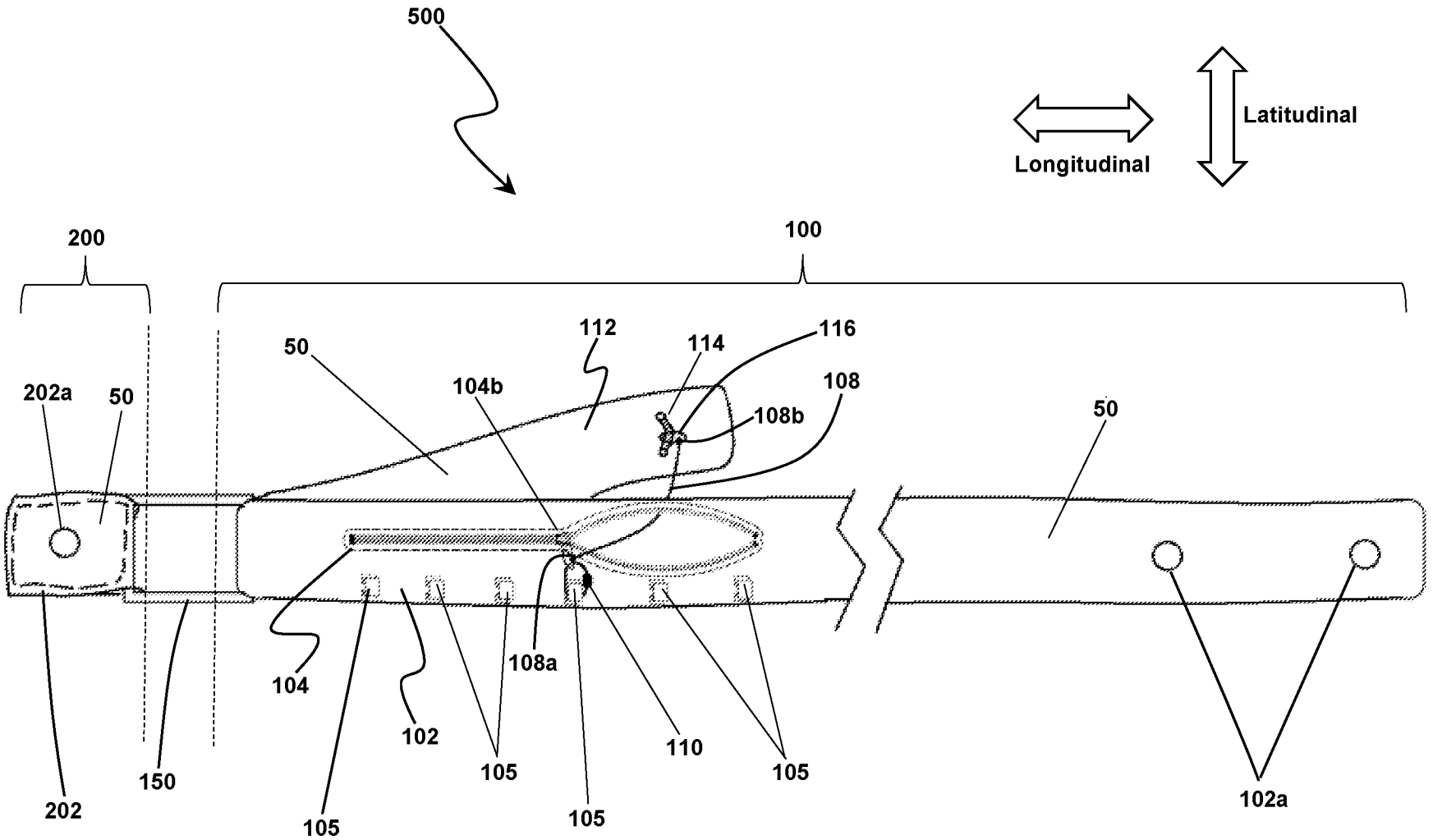
FIG. 1 illustrates a cut-away plan view of the adjustable length strap assembly for a stringed musical instrument in accordance to an embodiment of the present invention.
Figure 2:
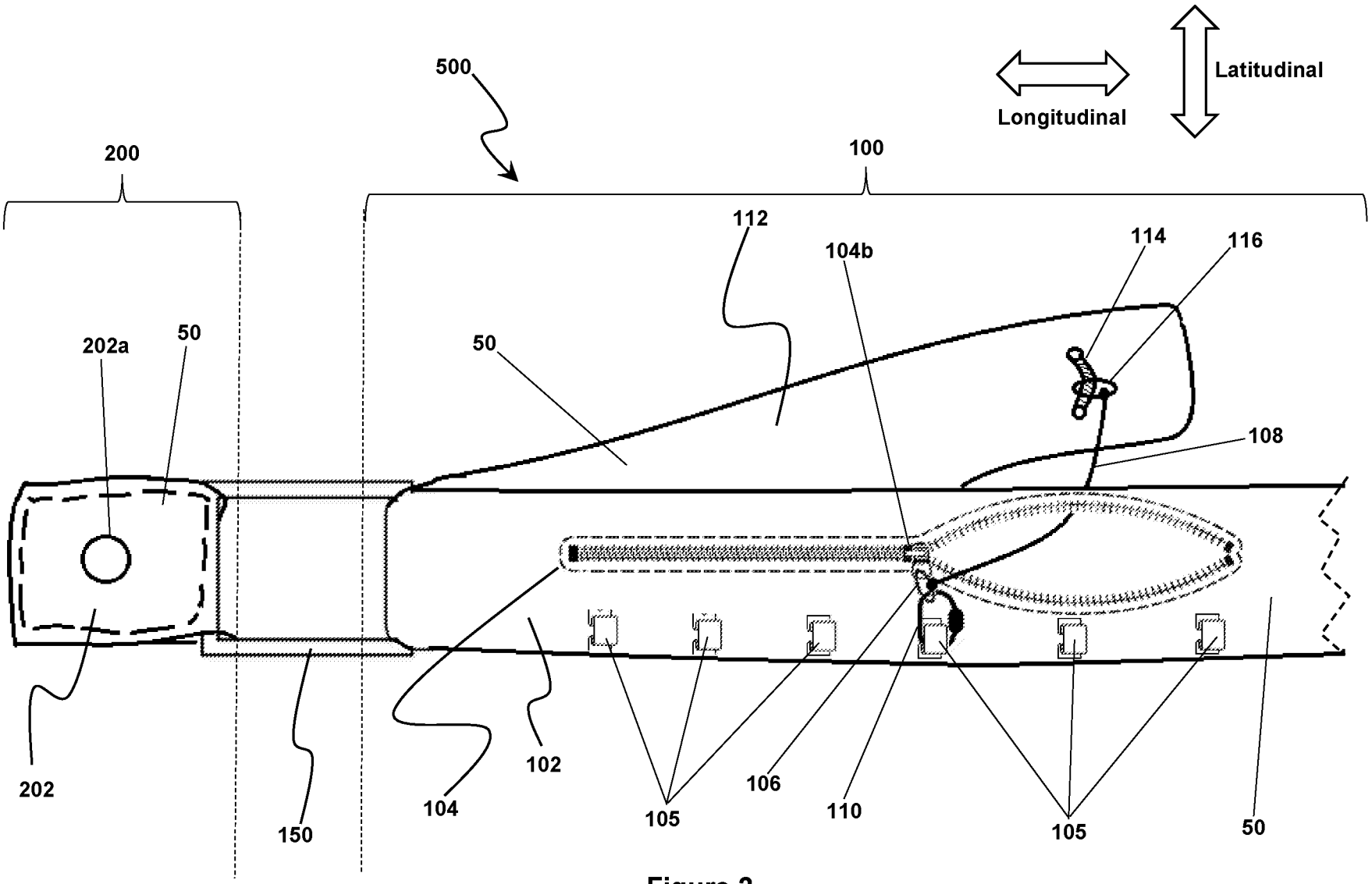
FIG. 2 illustrates a partial view of the adjustable length strap assembly for a stringed musical instrument in accordance to an embodiment of the present invention.
Figure 3:
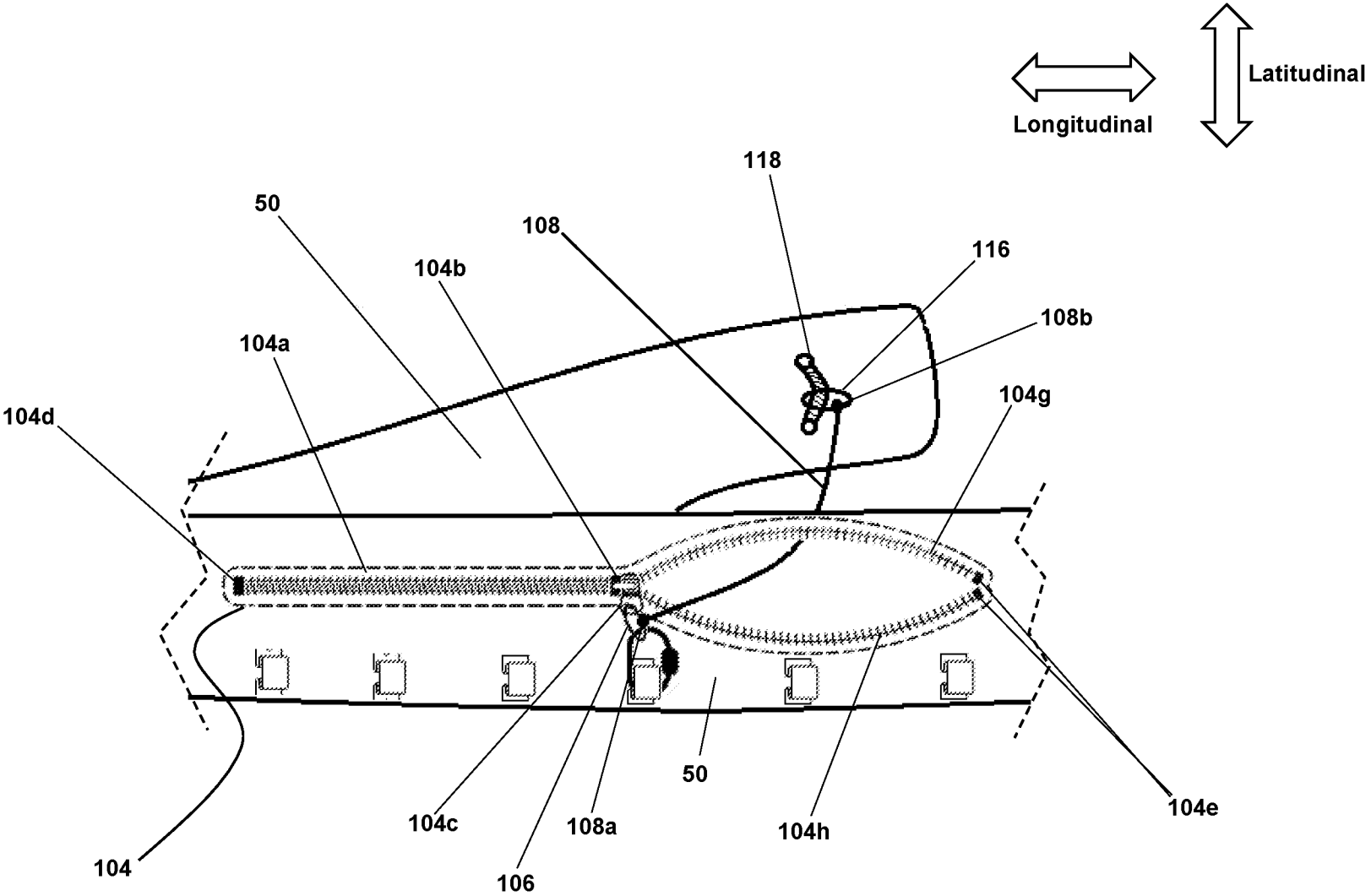
FIG. 3 illustrates a partial view of the first portion of the adjustable length strap assembly for a stringed musical instrument in accordance to an embodiment of the present invention which is directed at providing a close-up view of an exemplary slide-fastening mechanism formed integral to the first top ply of strapping material of the first portion of the adjustable length strap assembly.
Figure 5:
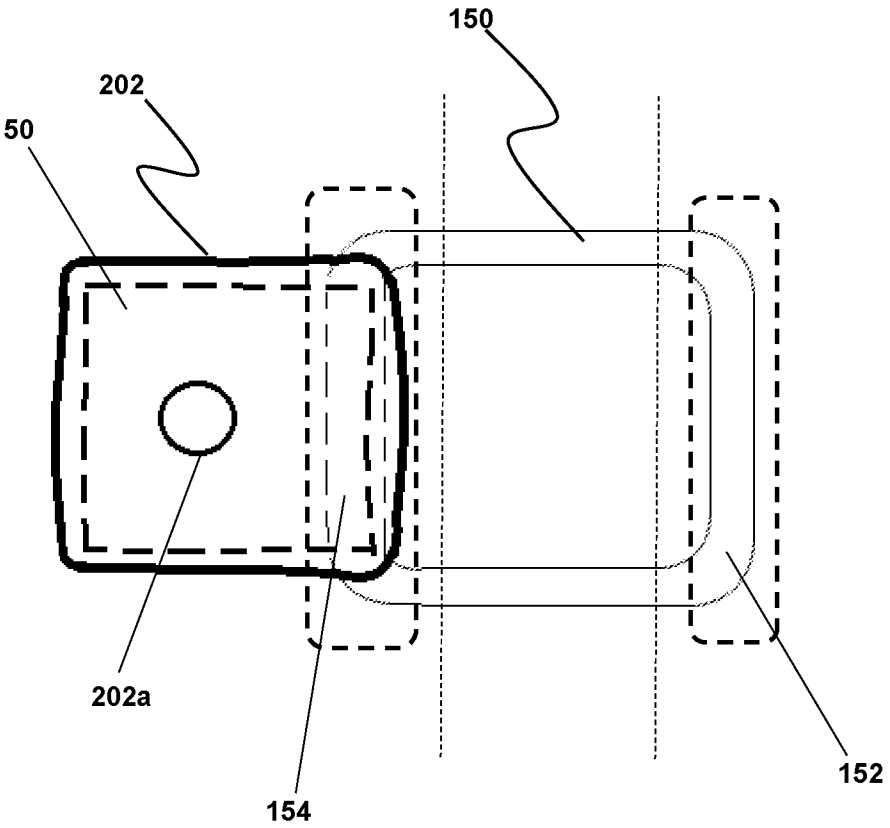
FIG. 5 illustrates a second portion of the adjustable length strap assembly for a stringed musical instrument in accordance to an embodiment of the present invention.
Figure 4:
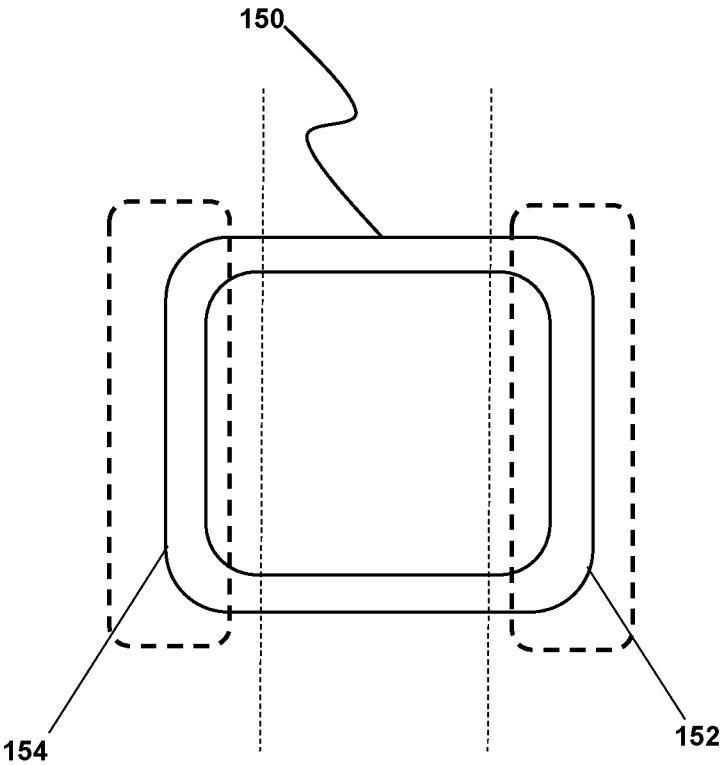
FIG. 4 illustrates a plan view of the substantially ring shaped leveraging member of the adjustable length strap assembly for a stringed musical instrument in accordance to an embodiment of the present invention.
Figure 6:
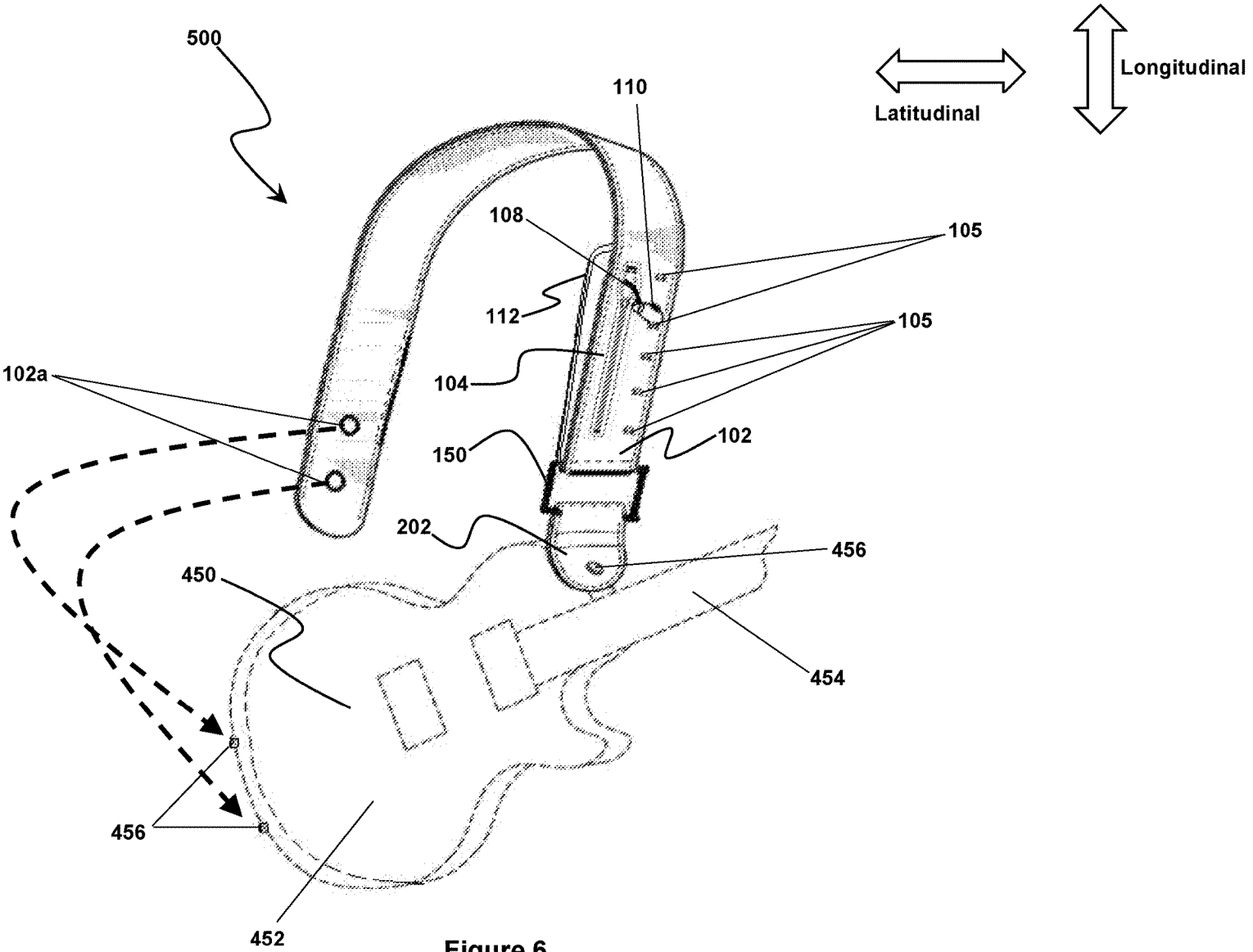
FIG. 6 illustrates a perspective view of the adjustable length strap assembly for a stringed musical instrument in accordance to an embodiment of the present invention and how it may be attached to anchoring points located at the back portion of the body of the stringed musical instrument and a head portion of the body of the stringed musical instrument.

The present invention which alludes to an adjustable length strap assembly for stringed musical instruments, will now be described with reference to FIGS. 1 to 6 appended herewith. More particularly, with reference to FIGS. 1 to 6, the present invention provides an adjustable length strap assembly 500 adapted for use with a stringed musical instrument of the type held in front of a performer or musician or user of the instrument, while it is being played by strumming of its strings by the performer, particularly a guitar. The adjustable length strap assembly 500 comprises:

a first portion 100 defined in part by a length of a strapping material 50 having a terminal end configured to be secured to an anchoring point located on a rear portion of a body 452 of the stringed musical instrument 450, said length of strapping material 50 is threaded through a substantially ring-shaped leveraging member 150 via a first leveraging portion 152 and folded, such that a section of the length of the strapping material 50 is folded over itself, to form a section having a two ply 102, 112 configuration of strapping material 50 consisting of a first top ply 102 and a second bottom ply 112, with slid-able longitudinal movement of each ply 102, 112 relative to the other leveraged by said first leveraging portion 152 of the substantially ring-shaped leveraging member 150; and a second portion 200 defined by a tongue 202 capable of swivelling about a second leveraging portion 154 of the substantially ring shaped leveraging member 150, the tongue 202 configured to attach to an anchoring point 456 located on a head portion of the body 452 of the stringed musical instrument 450;

characterized in that;

the slid-able longitudinal movement of the second bottom ply 112 of strapping material 50 of the first portion 100 of the strap assembly 500 relative to the first top ply 102 of strapping material 50 of the first portion 100 of the strap assembly 500 is regulated by movement of a slider 104*c* of a longitudinally oriented slide-fastening mechanism 104 formed integrally to the first top ply 102; and wherein the slider 104*c* is mechanically linked to a terminal portion of the second bottom ply 112 by way of a flexible mechanical interlink 108 such that longitudinal slid-able motion of the slider 104*b* of the slide-fastening mechanism 104 formed integrally to the first top ply 102 allows a corresponding slid-able longitudinal movement of the second bottom ply 112 and thereby provides for an adjustable length of strapping material 50 of the strap assembly 500 to be worn over the shoulder and around the neck and back of the user of the instrument, who can be referred to as a musician or a performer.

In accordance to an embodiment of the adjustable length strap assembly 500, the substantially ring shaped leveraging member 150 is fabricated from material selected from a list including metal, nylon coated metal, electro-plated metal, plastics and resin.

In accordance to an embodiment of the adjustable length strap assembly 500, the strapping material 50 of the first portion 100 of the strap assembly 500 is manufactured from material selected from a list including webbing made of nylon, cotton fibres, polypropylene and neoprene. In accordance to another embodiment of the adjustable length strap assembly 500, the strapping material 50 of the first portion 100 of the strap assembly 500 is manufactured from material selected from a list including leather and faux leather.

In accordance to a preferable embodiment of the present invention, the slide-fastening mechanism 104 formed integral to first top ply 102 of strapping material 50, is a zipper mechanism. More preferably, the slide-fastening mechanism 104 is a closed bottom zipper mechanism. More particularly, in accordance to said preferable embodiment, the slide-fastening mechanism 104, is a zipper mechanism as evident from any of FIGS. 1 to 3 appended herewith, and as such comprises a slider 104*b* engaged to a pull-tab 104*c* configured to allow the application of a pulling force by a user to allow movement of the slider 104*b*; a pair of toothed tracks 104*g*, 104*h* that each have tooth that mate complimentarily with tooth from the other track 104*g*, 104*h*, when forced into position by the slider 104*b*; a tape 104*a* of material stitched to the toothed tracks 104*g*, 104*h* that serves to interface the slide-fastening mechanism 104 with material surrounding edges of a slit formed on the first top ply 102 of the strapping material 50 of the first portion 100 of the adjustable length strap assembly 500 subjected to the fastening and unfastening action of the slide-fastening mechanism 104; a bottom stop 104*d* which serves to define a beginning point of the slide-fastening mechanism fastening action along the pair of toothed tracks 104*g*, 104*h*; and a pair of top stops 104*e* for each toothed track 104*g*, 104*h* which serves to define a terminal point of the slide-fastening mechanism 104 fastening action. In accordance to said preferable embodiment of the strap assembly 500 of the present invention, the slider 104*b* of the zipper mechanism, is a slider 104*b* having a locking mechanism integrated therein which prevents motion of the slider 104*b* along the tracks 104*g*, 104*h* of the slide-fastening mechanism 104 when the locking mechanism is engaged. Exemplarily, the slider 104 of the zipper mechanism in accordance to said preferable embodiment of the present invention, is a slider 104*b* selected from a list comprising a pin-lock slider and a key-lock slider. In accordance to said preferable embodiment of the length adjustable strap assembly 500 of the present invention, the slide-fastening mechanism 104 which is a closed bottom zipper mechanism having a slider 104*b* which is either a pin lock slider or key-lock slider, moving the slider 104*b* toward the bottom stop 104*d*, splits the two toothed tracks 104*g*, 104*h* apart to reveal an opening defined by the slit formed on the first top ply 102 of the first portion 100 of the length adjustable strap assembly 500. Conversely, moving the slider 104*b* toward the pair of top stops 104*e*, effectively causes the tooth of the pair of toothed tracks 104*g*, 104*h* to mate and thereby effectively fastens or seals the opening defined by the slit formed on the first top ply 102 of the first portion 100 of the length adjustable strap assembly 500.

In terms of construction of the integrally formed slide-fastening mechanism 104 on the first top ply 102, aforementioned slide-fastening mechanism is stitched into said first top ply 102 of strapping material 50, by presumably stitching the tape 104*a* attached to the toothed tracks 104*g*, 104*h* around spaced apart edges of an elongated slit (i.e. which defines an opening) formed on the first top ply 102 of the strapping material 50. The length of the slit formed on said first top ply 102 of the strapping material 50, roughly corresponds to an amount of length adjustment of the adjustable length strap assembly 500 that is required by design and accordingly also corresponds to a length of the second bottom ply 112 of strapping material 50 that extends outwardly from the first leveraging portion 152 of the substantially ring shaped leveraging member 150.

Reiterating again, in the context of the length adjustable strap assembly 500 as provided in an aspect of the present invention as described in the preceding paragraphs of this detailed description section, the slide-fastening mechanism 104 (i.e. a zipper mechanism, in accordance to a preferable embodiment) which is integrally formed on the first top ply 102 of the strapping material 50 of the first portion 100 of the strap assembly 500, serves the purpose of regulating movement of the second bottom ply 112 of the strapping material 50 via the first leveraging portion 152 of the substantially ring-shaped leveraging member 150. This is achieved by mechanically interlinking movement of the slider 104*b* of the slide-fastening mechanism 104 disposed and formed integrally on the first top ply 102 of strapping material 50, to the terminal portion of the second bottom ply 112 of strapping material 50 that extends outwardly and below the first top ply 102 of strapping material 50 from the first leveraging portion 152 of the substantially ring shaped leveraging member 150. More particularly, in accordance to said preferable embodiment of the adjustable length strap assembly 500 of the present invention, the pull tab 104*c* of the slide-fastening mechanism 104 which is mechanically engaged to the slider 104*b* is adapted to attach to a flexible mechanical interlink 108 which is also adaptably attached to a terminal portion of the second bottom ply 112 of strapping material 50.

In accordance to an embodiment, the pull tab 104*c* of the slide-fastening mechanism 104 is a perforated pull tab 104*c* capable of slidably receiving a ring-member 106 secured to a first end 108*a* of a flexible mechanical interlink 108 and the terminal portion of the second bottom ply 112 of strapping material 50 is retrofitted with a loop member 118 capable of slidably receiving a ring member 116 secured to a second end 108*b* of the flexible mechanical interlink 108, thereby mechanically interlinking the slider 104*b* of the slide-fastening mechanism 104 disposed on the first top ply 102 of strapping material 50 to the terminal portion of the second bottom play 112 of strapping material 50, via its pull-tab 104*c*. In accordance to an embodiment, the flexible mechanical interlink 108 mechanically interlinking the slider 104*b* of the slide-fastening mechanism 104 to the terminal portion of the second bottom ply 112 of strapping material 50, is a chain-link flexible mechanical interlink.

Moving on, due to the mechanical interlink formed by way of the flexible mechanical interlink 108 between the slider 104*b* of the slide-fastening mechanism 104 disposed on the first top ply 102 of strapping material 50 and the terminal portion of the second bottom ply 102 of strapping material 50, any travel or motion of the slider 104*b* along the tracks 104*g*, 104*h* of the slide-fastening mechanism 104, is coupled to the terminal portion of the second bottom ply 112.

Specifically, in accordance to the preferable embodiment of the adjustable length strap assembly 500 alluded to in FIGS. 1 to 6 appended herewith, travel of the slider 104*b* of the slide-fastening mechanism 104 disposed on the first top ply 102, toward the bottom stop 104*d*, results in undoing of the mating between the tooth of the tracks 104*g*, 104*h* to reveal the opening defining the elongated slit mentioned previously, and since the movement or travel of the slider 104*b* is mechanically interlinked to the terminal portion of the second bottom ply 112 by the flexible mechanical interlink 108 via the pull-tab 104*c* of the slider 104*b*, the second bottom ply 112 is effectively released for movement toward the direction of travel of the slider 104 (i.e. toward the bottom stop 104*d*), allowing rapid and hassle-free length adjustment of the length of strapping material 50 of the strap assembly 500 to be worn over a shoulder and around a neck and back of a musician/performer, by allowing the retracting by the musician/performer, of a portion of the effectively released second bottom ply 112 of strapping material 50 which corresponds to the length of travel of the slider 104*c* of the slide-fastening mechanism 104 disposed on the first top ply 102 of strapping material 50, via the first leveraging portion 152 of the substantially ring-shaped leveraging member 150. This corresponds to an increase of the length of strapping material 50 to be worn over a shoulder and around a neck and back of a musician/performer.

Likewise, travel of the slider 104*b* of the slide-fastening mechanism 104 disposed on the first top ply 102, toward the pair of top stops 104*e* of the pair of toothed tracks 104*g*, 104*h*, results in the mating of the tooth of the tracks 104*g*, 104*h* to seal the opening defining the elongated slit mentioned previously, and since the movement or travel of the slider 104*b* is mechanically interlinked to the terminal portion of the second bottom ply 112 by the flexible mechanical interlink 108 via the pull-tab 104*c* of the slider 104*b*, the second bottom ply 112 is urged forward, toward the direction of travel of the slider 104*b* (i.e. toward the pair of top stops 104*e*), which in turn draws a portion of the first top ply 102 of strapping material 50 via the first leveraging portion 152 of the substantially ring shaped leveraging member 150 to fold over itself and form part of a lengthened second bottom ply 112 of strapping material 50, once again allowing hassle-free length adjustment of strapping material 50 of the strap assembly 500 to be worn over a shoulder and around a neck and back of a musician/performer, by allowing the advancing by the musician/performer, of a portion of the effectively urged second bottom ply 112 of strapping material 50 which corresponds to the length of travel of the slider 104*c* of the slide-fastening mechanism 104 disposed on the first top ply 102 of strapping material 50. This corresponds to a decrease of the length of strapping material 50 to be worn over a shoulder and around a neck and back of a musician/performer.

It should be noted that in accordance to preferable embodiments of the adjustable length strap assembly 500 described in the preceding paragraphs above, since the slider 104*c* of the slide-fastening mechanism 104 (i.e. a zipper mechanism, in accordance to the preferable embodiments described herein) is selected from a list including a pin-lock slider and a key-lock slider, in which the motion or travel of the slider 104*b* along the tracks 104*g*, 104*h* of the slide-fastening mechanism 104 is prevented when the locking mechanism is engaged, it is possible for a desired length adjustment effected by a given sliding movement of the slider 104*c* of the slide-fastening mechanism 104 either toward the bottom stop 104*d* or the pair of top stops 104*e* of the adjustable length strap assembly 500 to be maintained. In this regard, it may be most preferable to employ a slide-fastening mechanism 104 having a slider 104*b* which is a key-lock slider as a slide-fastening mechanism 104 having a slider 104*b* which is a pin-lock slider suffers from the disadvantage of inadvertent disengagement of its locking mechanism.

Additionally, in accordance to a preferable embodiment of the adjustable length strap assembly 500 of the present invention, the first top ply 102 of strapping material 50 of the first portion 100 of the strap assembly 500 is further disposed with a plurality of equidistantly spaced apart positional locking tab members 105 distributed alongside the entire length of the longitudinally oriented slide-fastening mechanism 104. Specifically, in accordance to said preferable embodiment, each positional locking tab member 105 is configured to act in cooperation with the slider 104*b* of the longitudinally oriented slide-fastening mechanism 104 to limit the longitudinal mobility of the slider 104*b* over a predefined interval of length of the slide-fastening mechanism 104 by way of a latching member 110 adaptably received and housed by the slider 104*b* and serving to mechanically latch and interlock the slider 104*b* to a given positional locking tab member 105. More particularly, in accordance to said preferable embodiment of the adjustable length strap assembly 500 of the present invention, the pull-tab 104*c* of the slider 104*b* of the slide-fastening mechanism 104 is a perforated pull-tab 104*c* that slidably receives and houses a ring member 106 that in turn is capable of slidably receiving and housing a latching member 110. Exemplarily, the latching member 110 is selected from a list including a carabiner and any hook like latch implement. In accordance to said preferable embodiment of the adjustable length strap assembly 500 of the present invention, each positional locking tab member 105 exemplarily takes the form of a small loop of material stitching on to the first top ply 112 of strapping material 50.

Accordingly, in view of the description of the preceding paragraphs above, in accordance to a preferable embodiment of the length adjustable strap assembly 500 of the present invention, the combination of firstly, a slider 104*b* of the slide-fastening mechanism 104 having an integrated locking mechanism in which the motion or travel of the slider 104*b* along the tracks 104*g*, 104*h* of the slide-fastening mechanism 104 is prevented when the locking mechanism is engaged and secondly, the provision of the plurality of equidistantly spaced apart positional locking tab members 105 distributed alongside the entire length of the longitudinally oriented slide-fastening mechanism 104 which act in cooperation the latching member 110 secured to the perforated pull-tab 104*c* that is configured to mechanically latch to a given positional locking tab member 105 depending on a user's selection, to limit the longitudinal mobility of the slider 104*b* over a predefined interval of length of the slide-fastening mechanism 104, enables a given length adjustment of the length adjustable strap assembly 500 of the present invention to be maintained, while still allowing a limited degree of change to the adjustment which may occur due to movement of a performer's body.

In accordance to an embodiment of the adjustable length strap assembly 500 of the present invention, the terminal end of the length of strapping material 50 of the first portion 100 of the strap assembly 500 is adaptably configured to attach to an anchoring point 456 located on a rear portion of a body 452 of a stringed musical instrument 450 by way of being disposed with a slit aperture 102*a* adapted to snugly fit over an anchoring point 456 taking the form of a strap attachment stud or strap attachment button. In accordance to said embodiment of the adjustable length strap assembly 500 of the present invention, the tongue 202 of the second portion 200 of the strap assembly 500 is disposed on its substantially planar surface with a slit aperture 202*a* adapted to snugly fit over an anchoring point 456 located on a head portion of the body 452 of a stringed musical instrument 450, the anchoring point 456 taking the form of a strap attachment stud or strap attachment button.

Specifically, the tongue 202 of the second portion 200 of the adjustable length strap assembly 500 of the present invention, simply comprises, exemplarily a length of strapping material 50 folded over itself via the second leveraging portion 154 of the substantially ring-shaped leveraging member 150, with the resulting overlap of strapping material 50 being stitched together at an outwardly projecting portion, to form a flap of material that is free to swivel about the second leveraging portion 154 of the substantially ring-shaped leveraging member 150. In accordance to an embodiment of the adjustable length strap assembly 500, the tongue 202 of the second portion 200 of the strap assembly 500 is manufactured from material selected from a list including webbing made of nylon, cotton fibres, polypropylene and neoprene. In accordance to another embodiment of the adjustable length strap assembly 500, the tongue 202 of the second portion 200 of the strap assembly 500 is manufactured from material selected from a list including leather and faux leather.

It would be understood by those skilled in the art to which the length adjustable strap assembly 500 of the present invention pertains, that the length of the slide fastening mechanism 104 disposed on the first top ply 102 of strapping material 50, the length of the second bottom ply 112 of strapping material 50, the number of the positional locking tab members 105 of the plurality of positional locking tab members 105 distributed alongside the longitudinally oriented slide fastening mechanism 104, the longitudinal spacing between each positional locking tab member 105 of the plurality of positional locking tab members 105, and thereby the length of strapping material 50 of the adjustable length strap assembly 500 that is worn over the shoulder and around the neck and back of a user/performer/musician among others, represent variable design parameters which may be varied based on design requirements determined viable for commercialization.

Alternative embodiments will become apparent to those skilled in the art to which the present invention pertains without departing from its scope. Accordingly, the scope of the present invention is defined by the appended claims rather than the foregoing description.

The invention claimed is:

1. An adjustable length strap assembly adapted for use with a stringed musical instrument of a type held in front of a user of the instrument or performer while it is being played by the user or performer, particularly a guitar, the adjustable length strap assembly comprises:

a first portion defined in part by a length of a strapping material having a terminal end configured to be secured to an anchoring point located on a rear portion of a body of the stringed musical instrument, said length of strapping material threaded through a substantially ring-shaped leveraging member via a first leveraging portion and folded, such that a section of the length of the strapping material is folded over to form a section having a two ply configuration of strapping material consisting of a first top ply and a second bottom ply, with slid-able longitudinal movement of each ply relative to one another leveraged by said first leveraging portion of the substantially ring-shaped leveraging member; and a second portion defined by a tongue capable of swivelling about a second leveraging portion of the substantially ring shaped leveraging member, the tongue configured to attach to an anchoring point located on a head portion of the body of the stringed musical instrument;

characterized in that;

the slid-able longitudinal movement of the second bottom ply of strapping material of the first portion of the strap assembly relative to the first top ply of strapping material of the first portion of the strap assembly is regulated by movement of a slider of a longitudinally oriented slide-fastening mechanism formed integrally to the first top ply; and wherein the slider is mechanically linked to a terminal portion of the second bottom ply by way of a flexible mechanical interlink such that longitudinal slid-able motion of the slider of the slide-fastening mechanism formed integrally to the first top ply allows a corresponding slid-able longitudinal movement of the second bottom ply and thereby provides for an adjustable length of strapping material of the strap assembly to be worn over a shoulder and around a neck and back of the performer.

2. The adjustable length strap assembly according to claim 1, wherein the longitudinally oriented slide-fastening mechanism formed integral to the first top ply of strapping material of the first portion of the adjustable length strap assembly is either a zip-lock mechanism or a zipper mechanism.

3. The adjustable length strap assembly according to claim 2, wherein the slide-fastening mechanism is a zipper mechanism having a slider incorporating a locking mechanism which prevents motion of the slider along a track of the zipper mechanism when the locking mechanism is engaged.

4. The adjustable length strap assembly according to claim 3, wherein the slider of the slide-fastening mechanism is either a pin-lock slider or a key-lock slider.

5. The adjustable length strap assembly according to claim 2, wherein the zipper mechanism is a closed-bottom zipper mechanism.

6. The adjustable length strap assembly according to claim 1, wherein the flexible mechanical interlink, mechanically interlinking the slider of the slide-fastening mechanism to the terminal portion of the second bottom ply of strapping material, is a chain-link flexible mechanical interlink.

7. The adjustable length strap assembly according to claim 1, wherein the first top ply of strapping material of the first portion of the strap assembly is further disposed with a plurality of spaced apart positional locking tab members distributed alongside an entire length of the longitudinally oriented slide-fastening mechanism;

wherein each positional locking tab member is configured to act in cooperation with the slider of the longitudinally oriented slide-fastening mechanism to limit the longitudinal mobility of the slider over a predefined interval of length by way of a latching member adaptably received and housed by the slider, the latching member configured to mechanically latch and interlock the slider to a positional locking tab member.

8. The adjustable length strap assembly according to claim 7, wherein the plurality of spaced apart positional locking tab members are equidistantly spaced apart.

9. The adjustable length strap assembly according to claim 7, wherein the latching member is a hook-like latch implement.

10. The adjustable length strap assembly according to claim 1, wherein the substantially ring shaped leveraging member is fabricated from material including metal, nylon coated metal, electro-plated metal, plastics and resin.

11. The adjustable length strap assembly according to claim 1, wherein the strapping material of the first portion and second portion of the strap assembly is manufactured from material including faux leather, leather and webbing made from any one of nylon, cotton fibres, polypropylene and neoprene.

* * * * *